US006686846B1

(12) United States Patent
Lee

(10) Patent No.: US 6,686,846 B1
(45) Date of Patent: Feb. 3, 2004

(54) DETACHABLE ENTRANCE AND EXIT GATE WITH A COMBINED COMMODITY BURGLARPROOF AND WEAPON DETECTING SYSTEM

(76) Inventor: Bert Taeho Lee, 214 Madison Ave., Cresskill, NJ (US) 07626

( * ) Notice: Subject to any disclaimer, the term of this patent is extended or adjusted under 35 U.S.C. 154(b) by 0 days.

(21) Appl. No.: 10/282,282

(22) Filed: Oct. 28, 2002

(30) Foreign Application Priority Data

Sep. 11, 2002 (KR) ..... 20-2002-0027251

(51) Int. Cl.[7] ..... G08B 23/00

(52) U.S. Cl. ..... 340/693.5; 340/572.1; 340/551; 340/561

(58) Field of Search ..... 340/693.5, 541, 340/572.1–572.9, 545.2, 547, 550, 551, 552, 561, 567; 174/35 MS, 35 R, 32, 138 R

(56) References Cited

U.S. PATENT DOCUMENTS 3,665,448 A * 5/1972 McGlinchey et al. .... 340/568.1
4,251,808 A * 2/1981 Lichtblau ..... 340/572.7
4,357,535 A * 11/1982 Haas ..... 378/57
4,656,954 A * 4/1987 Tonali ..... 109/6
4,870,391 A * 9/1989 Cooper ..... 340/572.5
5,039,981 A * 8/1991 Rodriguez ..... 340/551
5,121,103 A * 6/1992 Minasy et al. ..... 340/551
6,076,303 A * 6/2000 Orsini ..... 49/68
6,362,739 B1 * 3/2002 Burton ..... 340/572.6
6,366,203 B1 * 4/2002 Burns ..... 340/551

* cited by examiner

*Primary Examiner*—Daniel J. Wu
*Assistant Examiner*—Phung Nguyen
(74) *Attorney, Agent, or Firm*—Cantor Colburn LLP

(57) ABSTRACT

A combination commodity burglarproof and weapon detecting system comprises: an entrance and exit gate having a pair of vertical side panels which are disposed inside an entrance and exit door; a central processing unit connected with a transmitter coil portion and a receiver coil portion of the gate; and an image-receiving device, a warning flare and a photographing device controlled by the central processing unit, in characterized that a I-type shielding panel for preventing an electromagnetic field interference to avoid unwanted operation of two different systems is installed between the weapon detecting portion and the commodity burglarproof portion so that these portions may be combined in one united body in the entrance and exit gate of the vertical panels.

4 Claims, 2 Drawing Sheets

DETACHABLE ENTRANCE AND EXIT GATE WITH A COMBINED COMMODITY BURGLARPROOF AND WEAPON DETECTING SYSTEM

BACKGROUND OF THE INVENTION

1. Field of the Invention

The present invention relates to a detachable entrance and exit gate with a combined commodity burglarproof and a weapon detecting system, which is adapted to detect all kinds of weapons such as a pistol, and prevent burglary of goods as well. More precisely, the present invention relates to a detachable entrance and exit gate, which can perform the function of a commodity burglarproof and a weapon detection simultaneously, while not giving uncomfortable feelings to a general messenger by installing the commodity burglarproof system with the weapon detector system in one united body in the gate.

2. Description of the Related Art

Currently, the purchase of a weapon, such as firearms, is conducted relatively freely and lawfully in some countries, therefore various crimes caused by weapons are on an increasing trend.

There have been a frequent number of criminal accidents caused by weapons in public places such as supermarkets, 24 hours convenience stores, liquor shops, schools, banks, airports and government offices. Therefore, in such places, an arched or grillage girder detecting gate is located inside the entrance and exit door which is mostly connected with the detecting system which detects any person carrying a weapon among those who pass through the entrance.

According to a conventional weapon detecting system, most of detecting gate, which are arranged inside an entrance and exit door, comprise a pair of side panels and an arched or straight panel, which connects the upper portion of the side panels to each other. These kinds of reverse U-shaped or grillage girder detecting gates give tension to persons passing through the entrance and exit door. Further, ordinary people who pass through the conventional detecting gate feel like they are entering a tunnel, so it gives them an unpleasant feeling and a hesitation.

Therefore, placing such a conventional arched detecting gates in public places such as supermarkets, 24 hours convenience stores, liquor shops, schools, banks, airports, government offices and the like in which the general public frequently visit as a part of daily life is a draw back. It gives psychological sense of oppression and a feeling of rejection to a customer and a student passing through those gates.

Furthermore, since a conventional commodity burglarproof system is very badly planned to a customer, there is a drawback in that it always gives an uncomfortable image to a customer.

In addition, since entrance and exit gates with a conventional weapon detecting and commodity burglarproof system are stationed inside the entrance separately and on each side, there is a drawback in that establishment expense cost a lot and because customers and persons passing through the entrance and exit doors receive psychological sense of oppression and a feeling of rejection due to the dual industrial structure.

SUMMARY OF THE INVENTION

Therefore, the present invention is invented to deal with the above problems, and the primary object of the present invention is to provide a simple structure. The detachable entrance and exit gate with a combination commodity burglarproof and weapon detecting system which may be disposed at the entrance and exit door to numerous sites, and without any limitations, such as, schools, supermarkets, 24 hour convenience store, liquor shops, banks, government offices and the like in which the general public visit frequently as a part of daily life, while giving no psychological sense of oppression and no feeling of rejection to persons passing through the door.

It is another object of the present invention is to provide a simple structure, and the detachable entrance and exit gate with a combination commodity burglarproof and weapon detecting system will also film any person carrying a weapon passing through an entrance and exit door or a person who possess stolen goods. After filming the suspect, it will promptly inform the manager and/or a person observing of the results with a warning indication lamp and/or a warning flare, so that criminal accidents caused by a weapon can be prevented and stolen articles can be recovered.

In the context of the present invention, these objects can be achieved by the following construction. That is, a detachable entrance and exit gate with a combination commodity burglarproof and weapon detecting system according to the present invention are comprised of as follows:

- a detachable entrance and exit gate having a pair of vertical side panels, which are disposed inside an entrance and exit door;
- a central processing unit connected with a transmitter coil portion and receiver coil portion of the gate; and
- an image-receiving device, a warning indication lamp and a photographing device controlled by the central processing unit, in characterized that
  - a I-type shielding panel for preventing an electromagnetic field interference to avoid unwanted operation of two different systems is installed between the weapon detecting portion and the commodity burglarproof portion so that these portions may be combined in one united body in the gate of the vertical panels.

BRIEF DESCRIPTION OF THE DRAWINGS

Other characteristic, objects, and advantages of the present invention appear on reading the following detailed description and on looking at the accompanying drawings, which are given by a way of non-limiting example and in which.

DESCRIPTION OF THE PREFERRED EMBODIMENTS

Preferred embodiments of the present invention will be described with reference to the drawings hereinafter.

Figure 1:
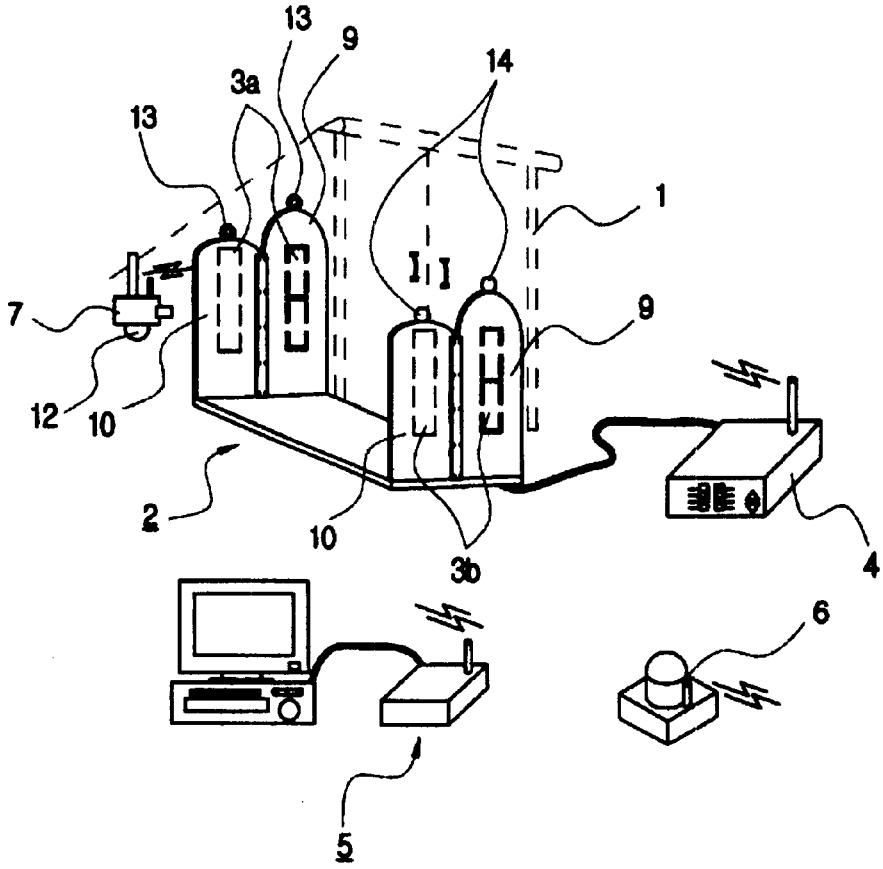
FIG. 1 is a location arrangement view of a detachable entrance and exit gate having,a combination commodity burglarproof and weapon detecting system according to the present invention.
Figure 2:
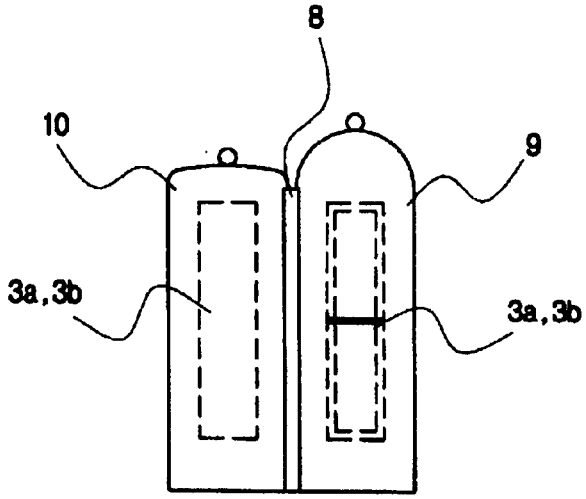
FIG. 2 is a front elevation view of a detachable entrance and exit gate forming the essential part of the present invention.
Figure 3:
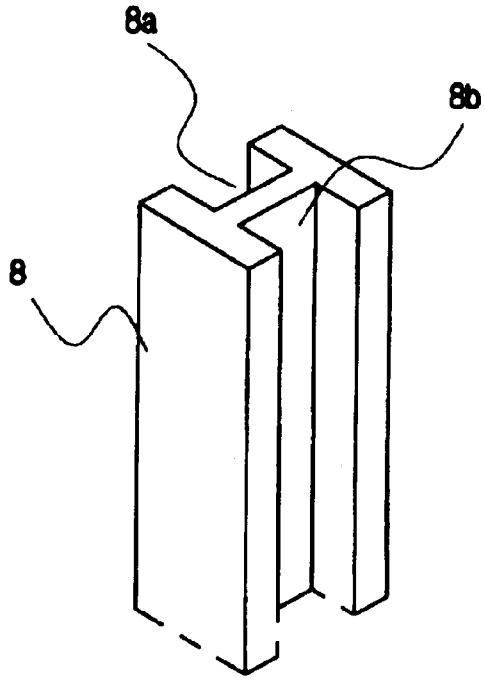
FIG. 3 is a perspective view of the shielding panel shown in FIG. 1
Figure 4:
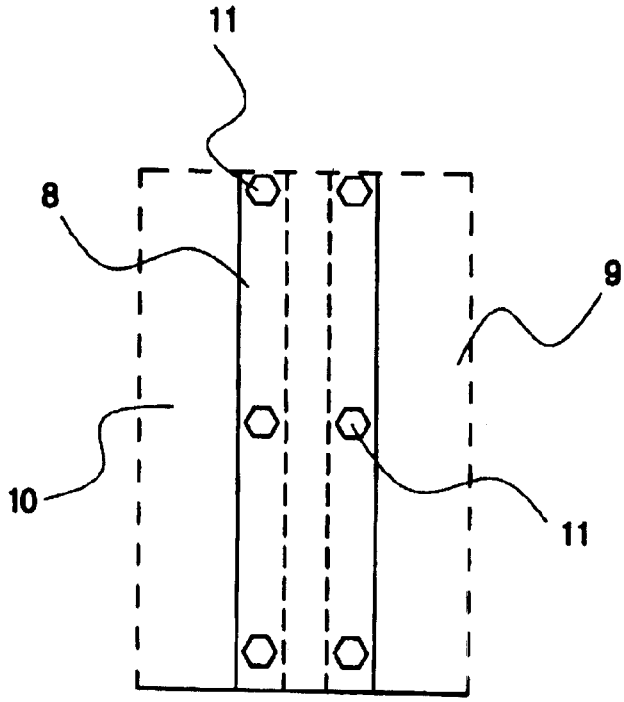
FIG. 4 is a partial front elevation view for showing the condition of the installation of the shielding panel shown in FIG. 3.

FIG. 1 is a location arrangement view of a detachable entrance and exit gate with a combined commodity burglarproof and weapon detecting system according to the present invention, FIGS. 2 to 4 illustrates main portions of the detachable entrance and exit gate for both the commodity burglarproof and weapon detecting system shown in FIG. 1.

In the drawings, a reference number 1 denotes an entrance and exit door; 2 a detachable entrance and exit gate; 9 a weapon detecting portion; 10 a commodity burglarproof portion.

The detachable entrance and exit gate with a combination commodity burglarproof and weapon detecting system of the present invention, as shown in FIG. 1, is constructed with a pair of vertical side panels, which are located inside the entrance and exit door 1, the central processing unit 4 connected with the transmitter coil portion 3*a* and the receiver coil portion 3*b*, and the image-receiving device 5, the warning flare 6 and the photographing device 7 controlled by the central processing unit 4, wherein the I-shaped shielding panel 8 preventing an electromagnetic field interference, as shown in FIG. 2, is interposed between the weapon detecting portion 9 and the commodity burglarproof portion 10.

As shown in FIGS. 3 and 4, grooves 8*a* and 8*b* is formed on the surface of both sides in the I-shaped shielding panel 8 such that the weapon detecting portion 9 and the commodity burglarproof portion 10 may be inserted and fastened with clamping means 11, such as bolts respectively.

The I-shaped shielding panel 8 is provided for reducing an signal interference of an electromagnetic field caused by the weapon detecting portion 9 and the commodity burglarproof portion 10, and is made from a metallic material for effectively shielding electromagnetic wave.

Furthermore, the operating frequency of the weapon detecting portion 9 and the commodity burglarproof portion 10 is established so as to minimize the electromagnetic field interference with each other.

In FIG. 1, a reference number 12 denotes a warning indication lamp; 13 a speaker; 14 a warning flare.

According to the present invention, when the weapon detecting system is operated, the receiver coils 3*b* which is contained in the side panels of the weapon detecting portion 9, receives the signals that has a constant frequency band transmitted by the transmitter coils 3*a*, which are contained in the side panels of the weapon detecting portion 9.

In this state, if any person carrying a weapon passes through the entrance and exit gate, which is comprised of the two side panels, when the receiver coils 3*b* receive the signals transmitted by the transmitter coils 3*a* and some variations of the electromagnetic field will be generated in the signal received by the receiver coil 3*b* due to the weapon. Then the central processing unit 4 may inspect the width of the scattered electromagnetic field variation, conduct a comparison and analysis between the variation width and predetermined weapon data and detect the weapon on the basis of the comparison values.

Thereafter, the image signals photographed by the photographing device 7, such as camera, is recorded on the PC monitor of the image-receiving device 5 by an antenna, while the signals output therefrom operate the warning flare 6 and/or the warning indication lamp 12.

Therefore, the weapon detecting system according to the present invention can film the weapon-carrying person's impression although they are dressed and inform to the manager and/or the person observing of such with the warning flare 6 and/or the warning indication lamp 12 and/or the warning flare 14 simultaneously.

On the other hand, the commodity burglarproof system is also operated by the same manner as described above. Namely, when a person, who possesses any stolen goods, passes through the entrance and exit gate 2, the system is operated in the same manner as described above, informing the results to a manager and/or a person observing of such with warning flare 6 and/or the warning indication lamp 12 and/or the warning flare 14 simultaneously, so that the burglary of goods can be prevented.

In conclusion, since the entrance and exit gate with the combined commodity burglarproof and weapon detecting system according to the present invention can be structurally simple and detachable, the establishment expense may be reduced and a customer and persons passing through the entrance and exit gate does not receive psychological sense of oppression and feeling of rejection.

If necessary, the weapon detecting system according to the present invention can be connected with an existing external security system of an expert security providing companies.

The present invention is not limited to the particular embodiment described above, but extends to any variants coming within its spirit.

What is claimed is:

1. A detachable entrance and exit gate detachable with a combination commodity burglarproof and weapon detecting system comprises:

an entrance and exit gate having a pair of vertical side panels, which are deposed inside an entrance and exit door;

a central processing unit connected with a transmitter coil portion and a receiver coil portion of the gate; and an image-receiving device, a warning flare and a photographing device controlled by the central processing unit, in characterized that a I-type shielding panel for preventing an electromagnetic field interference is installed between the weapon detecting portion and the commodity burglarproof portion so that these portions may be combined in one united body in the entrance and exit gate of the vertical panels.

2. A detachable entrance and exit gate according to claim 1, wherein grooves is formed on the surface of both sides in the I-shaped shielding panel such that the weapon detecting portion and the commodity burglarproof portion may be inserted and fastened with clamping means, such as bolts respectively.

3. A detachable entrance and exit gate according to claim 1, wherein the I-shaped shielding panel is made from a metallic material that can be shielded electromagnetic wave for reducing the signal interference of the electromagnetic field.

4. A detachable entrance and exit gate according to claim 1, wherein the operating frequency of the weapon detecting portion and the commodity burglarproof portion are established so as to minimize the electromagnetic field interference with each other.

* * * * *